US005528098A

United States Patent [19]

Dworsky et al.

[11] Patent Number: 5,528,098

[45] Date of Patent: Jun. 18, 1996

[54] REDUNDANT CONDUCTOR ELECTRON SOURCE

[75] Inventors: Lawrence N. Dworsky; James E. Jaskie, both of Scottsdale, Ariz.

[73] Assignee: Motorola, Schaumberg, Ill.

[21] Appl. No.: 319,402

[22] Filed: Oct. 6, 1994

[51] Int. Cl.[6] ..... H01J 1/02

[52] U.S. Cl. ..... 313/306; 313/309; 313/336; 313/351

[58] Field of Search ..... 313/306, 309, 313/336, 351, 495

[56] References Cited

U.S. PATENT DOCUMENTS 5,142,184 8/1992 Kane .
5,157,309 10/1992 Parker et al. ..... 313/309
5,194,780 3/1993 Meyer ..... 313/309

*Primary Examiner*—Sandra L. O'Shea
*Assistant Examiner*—Vip Patel
*Attorney, Agent, or Firm*—Robert F. Hightower

[57] ABSTRACT

An electron source is formed to have a redundant conductor extraction grid (17) and redundant column conductor (38, 39). Grid (17) has a plurality of conductor strips (21, 22) that overlay the column conductors (38, 39). When one conductor strip (21, 22) of the grid (17) is shorted to an underlying conductor, the non-shorted conductor remains usable. Similarly, the column conductors (38, 39) each have a plurality of column conductor strips (14, 25, 41, 42) that underlie the grid (17). When one column conductor strip (14, 25, 41, 42) is shorted to the grid (17), the non-shorted column conductor strip remains usable.

21 Claims, 3 Drawing Sheets

10

REDUNDANT CONDUCTOR ELECTRON SOURCE

BACKGROUND OF THE INVENTION

The present invention relates, in general, to electron emission display devices, and more particularly, to a novel extraction grid for an electron emission source.

Field emission devices (FEDs) are well known in the art and are commonly employed for a broad range of applications including image display devices. An example of a FED is given in U.S. Pat. No. 5,142,184 issued to Robert C. Kane on Aug. 25, 1992. FEDs typically employ at least two electrodes, a cathode conductor and a gate or extraction grid. Generally, the extraction grid and the cathode conductor are formed at right angles to facilitate utilizing row and column addressing to stimulate electron emission from emission tips or emitters. The cathode conductor and the extraction grid typically are electrically isolated by a dielectric layer. During the FED formation, pinholes can form in the dielectric layer and result in electrical shorts between the extraction grid and the cathode conductor. Because of the electrical short, the cathode conductor and the extraction grid are forced to the same potential thereby preventing a column of emitters and the row from being energized. The shorted column of emitters can not generate an image, thus, a display device formed with such electrical shorts usually appear as a dark or continually bright line where the shorted emitters are positioned.

Accordingly, it is desirable to have an electron source that remains functional if the extraction grid is shorted to the cathode conductor.

DETAILED DESCRIPTION OF THE DRAWINGS

Figure 1:
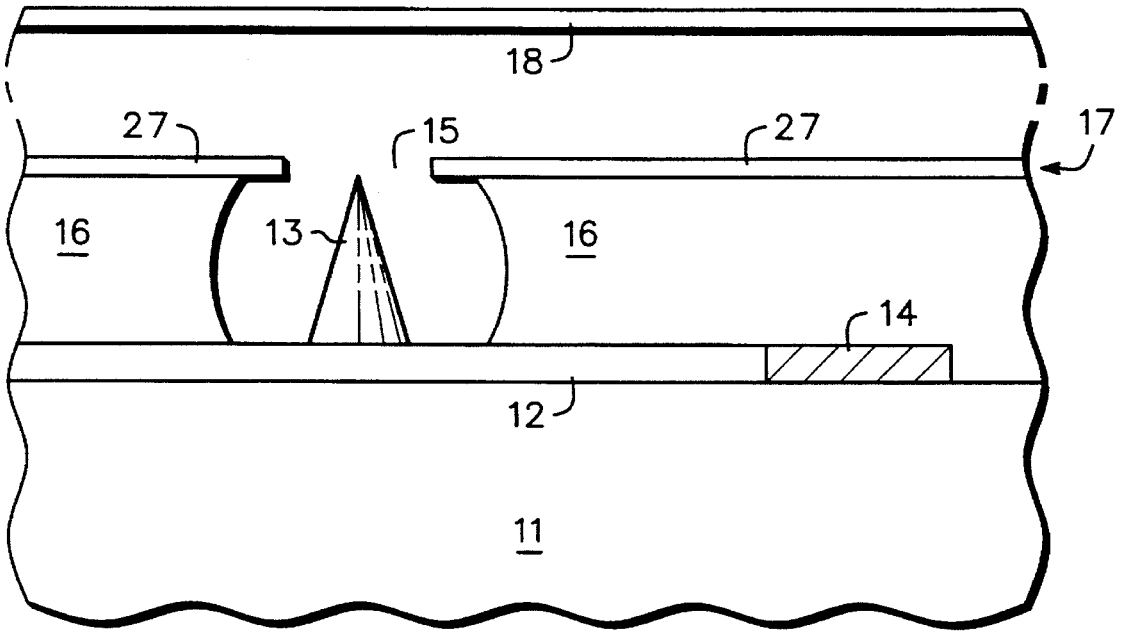
FIG. 1 schematically illustrates an enlarged cross-sectional portion of a display device in accordance with the present invention.

FIG. 1 schematically illustrates an enlarged cross-sectional portion of a field emission display device 10 that has a novel electron source with redundant conductors. The electron source includes a novel redundant conductor scheme for an extraction grid 17 and for column conductors of the electron source. As will be more apparent in the subsequent discussion of FIG. 2, grid 17 has a plurality of extraction elements such as an extraction element 27 shown in FIG. 1. Device 10 has a substrate 11 on which other portions of device 10 are formed. Substrate 11 typically is an insulating or a semi-insulating material, for example, silicon having a dielectric layer or glass. In the preferred embodiment, substrate 11 is glass. The electron source of device 10 includes a resistive layer that generally is formed into a plurality of resistive sections on substrate 11 such as a resistive section 12 as will be seen hereinafter. The plurality of resistive sections typically are utilized as ballast resistors. The electron source also has a column conductor that includes a first column conductor strip 14 which is utilized to provide electrical contact between an emitter 13 that is formed on section 12 and an external voltage source (not shown). As will be seen hereinafter in FIG. 3, the electron source includes a second column conductor strip 25 that is not shown in FIG. 1. Although only one emitter 13 is shown in the portion illustrated in FIG. 1, the electron source has a plurality of emitters 13 as will be seen hereinafter. Grid 17 is disposed on a dielectric layer 16 to electrically isolate grid 17 from substrate 11, strip 14, and section 12. Grid 17 has an emission opening 15 that is substantially centered to emitter 13 to permit electrons to travel from emitter 13 to a distally disposed anode 18 and form an image thereon. The surface of anode 18 facing emitter 13 typically is coated with a phosphor in order to provide a display as electrons strike anode 18.

Figure 2:
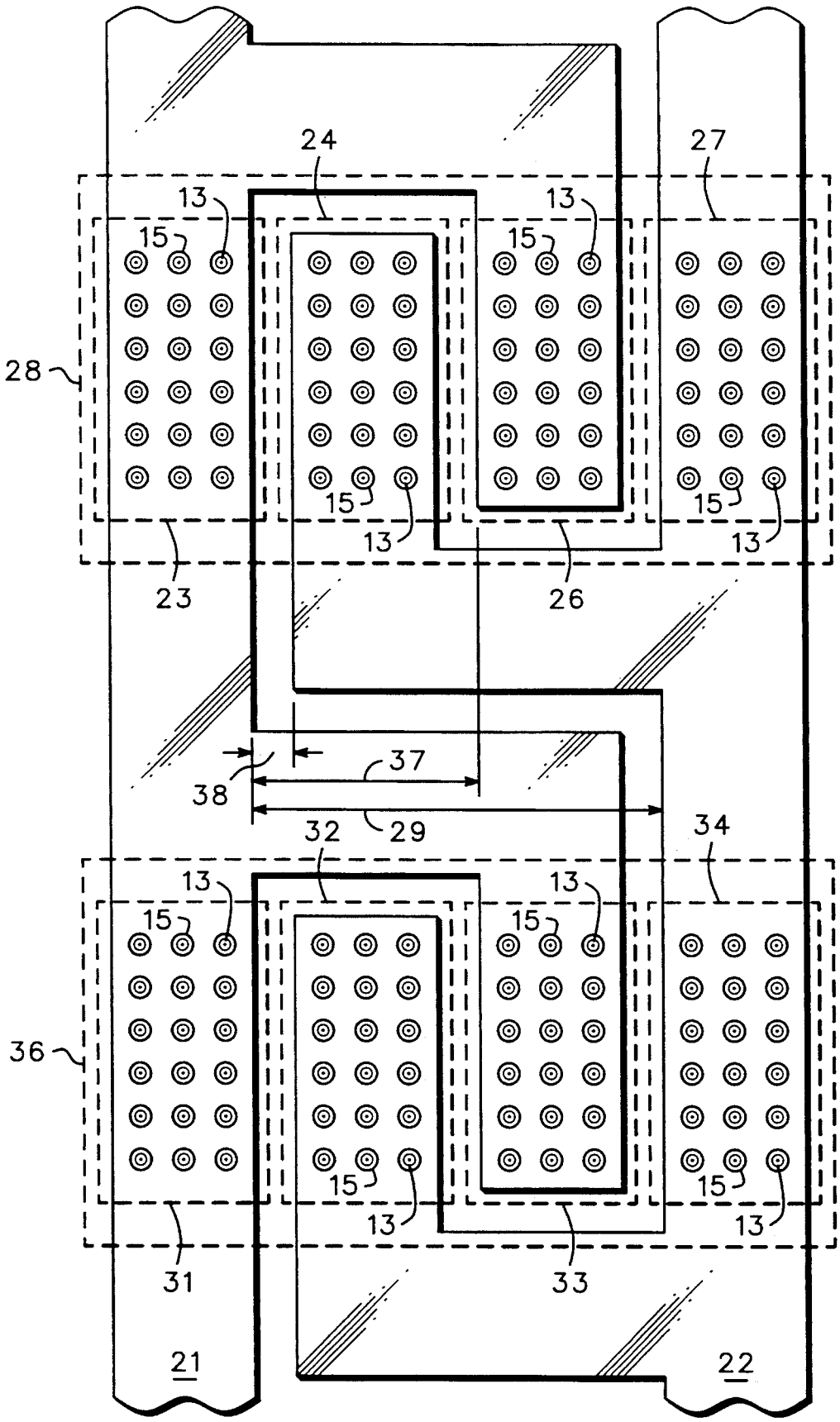
FIG. 2 schematically illustrates a plan view of a portion of an extraction grid in accordance with the present invention.

FIG. 2 schematically illustrates an enlarged plan view of a portion of extraction grid 17 shown in FIG. 1. Elements of FIG. 2 having the same reference numbers as FIG. 1 are the same. Device 10 (FIG. 1) has a plurality of emitters 13 as indicated in the discussion of FIG. 1. Emitters 13 are arranged in groups wherein each group is within a pixel area such as a first pixel area 28 and a second pixel area 36. The emitters within one pixel area are utilized to form a single pixel image on anode 18 (FIG. 1). Pixel areas 28 and 36 usually occur where grid 17 overlies emitters 13 and the associated column conductors such as the column conductor that includes strips 14 and 25 shown hereinafter in FIG. 3.

Grid 17 is formed as a plurality of conductors that are electrically isolated so that a short between one conductor of grid 17 and either of strips 14 or 25 (FIG. 3) still allows the other conductor of grid 17 to function. To accomplish this, grid 17 has a plurality of extraction elements within each pixel area wherein at least one extraction element generally is electrically connected to one of the plurality of conductors of grid 17. Each of the plurality of conductors of grid 17 may have a plurality of such extraction elements within each pixel area.

In the preferred embodiment, the plurality of conductors of grid 17 includes a first conductor strip 21 that is positioned near an edge of pixel areas 28 and 36, and a substantially parallel second conductor strip 22 that is spaced a distance 29, illustrated by an arrow, from conductor strip 21. Distance 29 is approximately twelve to twenty-five microns in order to obtain the desired pixel density. Strips 21 and 22 are approximately two to one hundred microns wide in order to have a low resistance to minimize switching time, and to match the pixel size. Strip 22 is positioned near an edge of pixel areas 28 and 36 that is opposite of strip 21. Within pixel area 28, grid 17 has a first extraction element 23, illustrated by a dashed box, and a second extraction element 26, also illustrated by a dashed box. Element 23 is formed in the portion of conductor strip 21 overlying emitters 13, and element 26 is adjacent to and substantially parallel to strip 22. Element 26 is electrically connected to strip 21 by an "L" shaped conductor extension of strip 21. A third extraction element 27, illustrated by a dashed box, is formed in the portion of conductor strip 22 overlying emitters 13, and a fourth extraction element 24, illustrated by a dashed box, is adjacent to and substantially parallel to strip 21 and is between strip 21 and element 26. Element 24 is electrically connected to strip 22 by an "L" shaped conductor extension of strip 22. Consequently, element 26 is a second distance 37 from element 23, and element 24 is a third distance 38 from element 23 such that distance 37 is less than distance 29, and distance 38 is less than distance 37. Elements 23, 24, 26, and 27 can have other shapes, for example, each conductor strip 21 and 22 may have only one large square projecting from each of conductor strips 21 and 22. Each element 23, 24, 26, and 27 has a plurality of emission openings 15 wherein each opening corresponds to an emitter of plurality of emitters 13 as indicated in the discussion of FIG. 1.

Grid 17 also has, within pixel area 36, extraction elements 31, 32, 33, and 34 that are similar to elements 23, 24, 26, and 27, respectively. It should be noted that the portion of device 10 shown in FIG. 1 is a cross-section that cuts through element 27 so that only the portion that includes an emitter 13 that is near strip 14 is shown in the FIG. 1 cross-section.

If either strip 21 or 22 is shorted to an underlying cathode conductor, then the external grid voltage (not shown) can be applied to the remaining non-shorted strip of strips 21 and 22 in order to provide an image on anode 18 (FIG. 1). The shorted strip of strips 21 and 22 is not utilized. The short can be determined when device 10 (FIG. 1) is tested prior to connecting all external electronics (not shown) to display 10.

Figure 3:
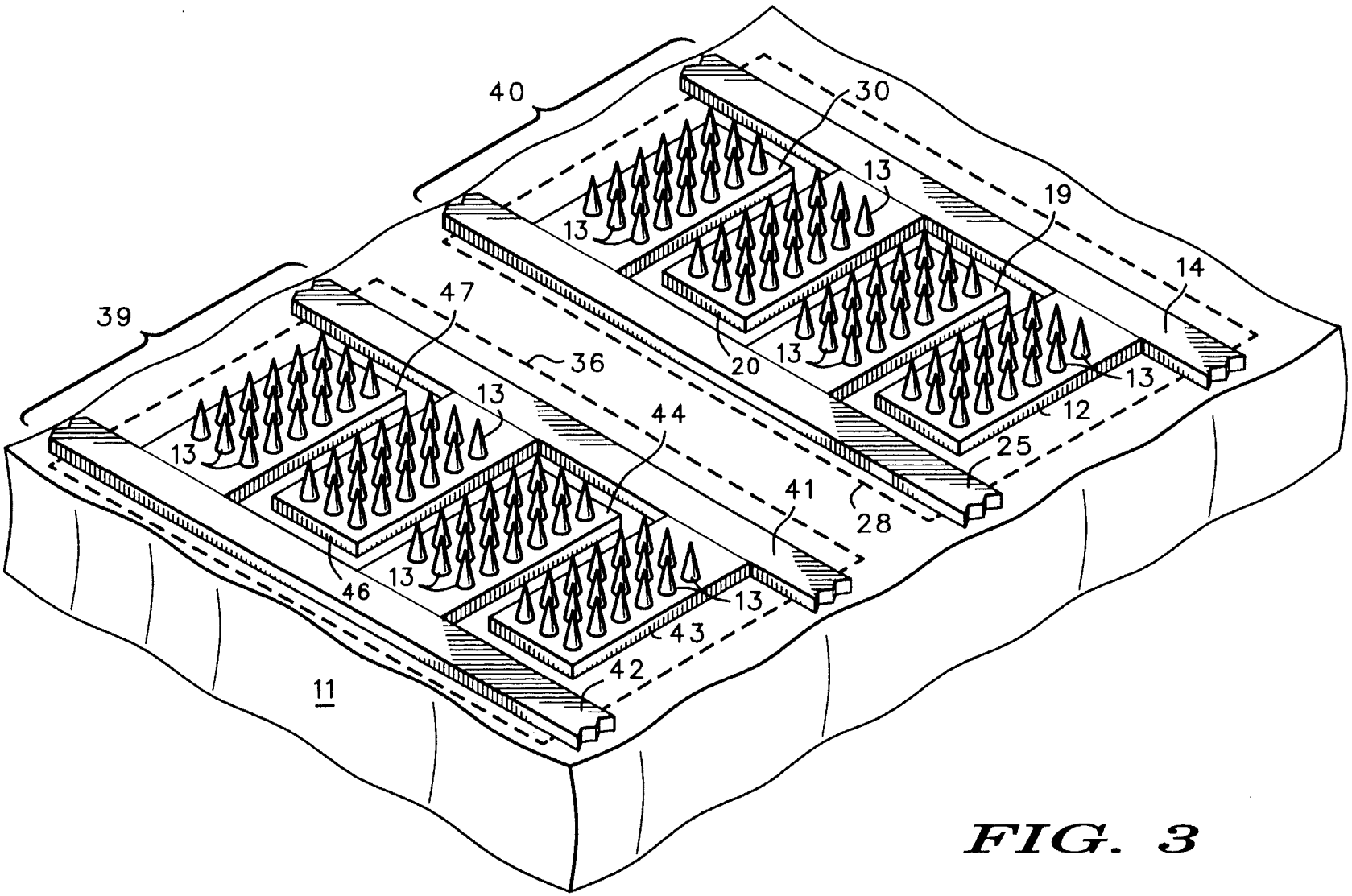
FIG. 3 illustrates a plan view of a portion of a cathode conductor in accordance with the present invention.

FIG. 3 schematically illustrates novel redundant cathode conductors 39 and 40 that also facilitate using device 10 when an electrical short occurs. Elements of FIG. 3 that are the same as FIG. 1 and FIG. 2 have the same reference numbers. Conductor 40 includes strip 14 and strip 25 that a substantially parallel and along opposite sides of area 28. A plurality of resistive sections 12, 19, 20, and 30 are formed on substrate 11 between strips 14 and 25 in area 28. Sections 12, 19, 20, and 30 are formed in a pattern to underlie extraction elements 27, 26, 24, and 23 (FIG. 2), respectively. Sections 12, 19, 20, and 30 can be formed by applying a continuous resistive layer and etching the layer as is well known to those skilled in the art. Strip 14 connects sections 12 and 20 into a pattern that corresponds to elements 27 and 24, respectively, while strip 25 connects sections 19 and 30 into a pattern that corresponds to elements 26 and 23, respectively. Emitters 13 are then formed on sections 12, 19, 20, and 30. For simplicity of the drawing, only six emitters are illustrated on each section 12, 19, 20, and 30 in FIG. 3.

Similarly, conductor 39 is within area 36 and includes a conductor strip 41 and a conductor strip 42 that corresponds to strips 14 and 25, respectively. Area 36 also has sections 43, 44, 46, and 47 that are similar to sections 12, 19, 20, and 30, and that correspond to the pattern of elements 34, 33, 32, and 31 (FIG. 2), respectively.

Utilizing grid 17 (FIG. 2) together with the redundant conductor cathode conductor of FIG. 3 provides several possible usable connections if a short occurs. If strip 14 shorts to strip 21 (FIG. 2), then strip 25 and strip 22 (FIG. 2) are still usable to form an image on anode 18 (FIG. 1). Also, using the redundant cathode conductor of FIG. 3 provides an advantage over prior art cathode conductors even when the redundant cathode conductor is used with a prior art single conductor extraction grid. In such a case, the prior art extraction grid can short to one of strips 14 or 25 yet the non-shorted one of strips 14 and 25 remains available to be used for emitting electrons. For example, if a prior art extraction grid shorts to strip 14, strip 25 may not be shorted. When an external voltage is applied to the prior art extraction grid, strip 14 and emitters 13 on resistive sections 12 and 20 are at the same potential as the prior art extraction grid. But, strip 25 and emitters 13 on resistive sections 19 and 30 are at a different potential, thus, emitters 13 on sections 19 and 30 can emit electrons.

By now it should be appreciated that there has been provided a novel redundant conductor electron source that facilitates using the electron source even if there is an electrical short within the electron source. Forming the extraction grid of the electron source into a plurality of electrically isolated conductor strips permits using non-shorted grid conductors to create an image. Similarly forming a redundant cathode conductor facilitates using non-shorted portions of the cathode conductor to create an image. Consequently, display devices that have shorted conductors can be used instead of discarded thereby increasing the yield and lowering the display device costs.

What is claimed is:

1. A redundant conductor electron source comprising:

an extraction grid having a first conductor strip and a second conductor strip that is substantially parallel to the first conductor strip, the second conductor strip spaced a first distance from the first conductor strip wherein the first conductor strip is electrically isolated from the second conductor strip;

a first extraction grid element having a first plurality of emission openings formed within a portion of the first conductor strip that is within a first pixel area of the electron source; and a second extraction grid element having a second plurality of emission openings formed within a portion of the second conductor strip that is within the first pixel area of the electron source, the second extraction grid element substantially parallel to the first extraction grid element and spaced the first distance from the first extraction grid element.

2. The electron source of claim 1 further including a third extraction grid element substantially parallel to the first extraction grid element and spaced a second distance from the first extraction grid element wherein the second distance is less than the first distance, the third extraction grid element within the first pixel area and electrically connected to the first extraction grid element.

3. The electron source of claim 2 further including a fourth extraction grid element substantially parallel to the first extraction grid element and spaced a third distance from the first extraction grid element wherein the third distance is less than the second distance, the third extraction grid element within the first pixel area and electrically connected to the second extraction grid element.

4. The extraction grid of claim 3 wherein the third and fourth extraction grid elements each have a plurality of emission openings therethrough.

5. The electron source of claim 1 further including:

a substrate;

a column conductor on the substrate wherein the column conductor underlies both the first conductor strip and the second conductor strip within the first pixel area; and a dielectric layer on the substrate and on a portion of the column conductor wherein the first conductor strip, the second conductor strip, the first extraction grid element, and the second extraction grid element are on the dielectric layer.

6. The electron source of claim 5 wherein the column conductor includes a first column conductor strip and a substantially parallel second column conductor strip.

7. The electron source of claim 1 further including a first resistive section underlying the first extraction grid element and a second resistive section underlying the second extraction grid element, the first resistive section electrically connected to a first column conductor strip and the second resistive section electrically connected to a second column conductor strip wherein the first and second resistive sections are within the first pixel area.

8. The electron source of claim 7 further including a first plurality of emitters on the first resistive section underlying the first extraction grid element and a second plurality of emitters on the second resistive section underlying the second extraction grid element.

9. The electron source of claim 1 wherein the first and the second conductor strip are approximately 2 microns to 100 microns wide.

10. The electron source of claim 1 wherein the first distance is approximately 10 microns to 500 microns.

11. A redundant conductor electron source comprising:

a first resistive section on a substrate and within a pixel area of the electron source;

a second resistive section on the substrate and within the pixel area, the first resistive section electrically isolated from the second resistive section;

a first column conductor strip electrically coupled to the first resistive section; and a second column conductor strip electrically coupled to the second resistive section and electrically isolated from the first column conductor strip.

12. The electron source of claim 11 further including a first extraction grid element overlaying the first resistive section and a second extraction grid element overlaying the second resistive section wherein the first extraction grid element is electrically isolated from the second extraction grid element.

13. The electron source of claim 12 further including a first conductor strip electrically coupled to the first extraction grid element and a second conductor strip electrically coupled to the second extraction grid element wherein the first conductor strip is electrically isolated from the second conductor strip.

14. An redundant conductor electron source comprising:

a plurality of juxtaposed conductors in a plane within a pixel area of the electron source wherein the plurality of juxtaposed conductors are electrically isolated;

a first extraction grid element within the pixel area and electrically connected to a first conductor of the plurality of juxtaposed conductors, the first extraction grid element having a first emission opening; and a second extraction grid element within the pixel area and electrically connected to a second conductor of the plurality of juxtaposed conductors wherein the second extraction grid element is electrically isolated from the first extraction grid element, the second extraction grid element having a second emission opening.

15. The source of claim 14 wherein the first extraction grid element overlays a plurality of emitters.

16. The source of claim 14 wherein the plurality of juxtaposed conductors overlie a plurality of column conductors.

17. A method of forming a redundant conductor electron source comprising:

forming a plurality of conductors in a first plane of the electron source and within a pixel area of the electron source so that shorting a first conductor of the plurality of conductors to a conductor in a second plane of the electron source does not short remaining conductors of the plurality of conductors to the conductor in the second plane.

18. The method of claim 17 wherein forming the plurality of conductors in the first plane includes forming a first column conductor strip and a second column conductor strip of a column conductor.

19. The method of claim 17 wherein so that shorting the first conductor of the plurality of conductors to the conductor in the second plane of the electron source does not short remaining conductors of the plurality of conductors includes so that shorting the first conductor of the plurality of conductors to a first conductor strip of an extraction grid in the second plane of the electron source does not short remaining conductors of the plurality of conductors to the first conductor strip of an extraction grid.

20. The method of claim 17 wherein forming the plurality of conductors in the first plane includes forming a first conductor strip of an extraction grid and a second conductor strip of the extraction grid.

21. The method of claim 17 wherein so that shorting the first conductor of the plurality of conductors to the conductor in the second plane of the electron source does not short remaining conductors of the plurality of conductors includes so that shorting the first conductor of the plurality of conductors to a first column conductor strip in the second plane of the electron source does not short remaining conductors of the plurality of conductors to the first column conductor strip.

* * * * *